US005144917A

United States Patent [19]

Hammett

[11] Patent Number: 5,144,917

[45] Date of Patent: Sep. 8, 1992

[54] FREE-PISTON ENGINE

[76] Inventor: Robert B. Hammett, 107 Riverdale Dr., Covington, La. 70433

[21] Appl. No.: 642,084

[22] Filed: Jan. 16, 1991

Related U.S. Application Data

[63] Continuation of Ser. No. 489,251, Mar. 5, 1990, abandoned, which is a continuation of Ser. No. 121,066, Oct. 13, 1987, Pat. No. 4,920,928, which is a continuation of Ser. No. 801,423, Nov. 25, 1985, abandoned, which is a continuation of Ser. No. 583,665, Feb. 27, 1984, abandoned.

[51] Int. Cl.[5] ..... F01B 11/00

[52] U.S. Cl. ..... 123/46 SC; 123/65 E

[58] Field of Search ..... 123/46 R, 46 A, 46 SC, 123/65 E, 65 PE, 65 WV

[56] References Cited

U.S. PATENT DOCUMENTS

| | | | |
|---|---|---|---|
| 1,036,288 | 8/1912 | Matricardi | 123/46 A |
| 2,995,122 | 8/1961 | Randall | 123/46 R |
| 3,119,230 | 1/1964 | Kosoff | 123/46 R |
| 4,705,460 | 11/1987 | Braun | 123/46 SC |

FOREIGN PATENT DOCUMENTS

| | | | |
|---|---|---|---|
| 0651973 | 11/1962 | Canada | 123/46 A |

*Primary Examiner*—Willis Wolfe, Jr.

[57] ABSTRACT

This gas pressure generating engine has a totally unconnected piston running between a combustion chamber and a rebounding volume. The piston uncovers the outlet port after moving a short distance from the combustion chamber and utilizes the rest of the piston's long stroke to draw in new air; and after turning around at the stroke's end to pump to the outlet a large part of the drawn-in air. The remainder of the drawn-in air is further compressed for combustion. The stroke of the piston is restricted only by the energy it receives from the combustion chamber. The rebounding volume's pressure is adjustable to adjust the pressure-volume ratio of the outlet gas. A tuned valve in the outlet and a tuned blowdown tube maximize gas momentum scavenging of the combustion chamber to improve the efficiency and extend the operating range.

27 Claims, 1 Drawing Sheet

PRESSURE
VOLUME

FREE-PISTON ENGINE

This application is continuation, of application Ser. No. 489,251 filed Mar. 5,1990, now abandoned, which is a continuation of application Ser. No. 121,066 filed Oct. 13, 1988 now U.S. Pat. No. 4,920,928 which is a continuation of abandoned application Ser. No. 801,423 filed Nov. 25, 1985, which is a continuation of abandoned application Ser. No. 583,665 filed Feb. 27, 1984.

TECHNICAL FIELD

This invention relates to cyclic engines or motors and their processes, and particularly engines whose piston does not require a mechanical driving mechanism and whose output is pressurized gas.

BACKGROUND ART

Most free-piston engines have used the common two-stroke cycle in which the output exhaust port was reached near the end of the piston's outward stroke and can not efficiently accommodate by changing the stroke length variation in power level or cycle-to-cycle fluctuations in combustion. Two stroke cycle free-piston engine require supercharging to force gas into the combustion chamber against the back-pressure of the output, and waste considerable energy in the their necessary pneumatic process. matricard U.S. Pat. No. 1,036,288, which releases gases from the cylinder part way through the expansion and compression strokes, operates a single piston between two combustion chambers a fixed distance apart and is therefore also unable to accommodate significant variations of stroke. Free-piston engines have had difficulty in cooling and lubricating their pistons. Dual piston free-piston have sometimes had to resort to a racks and pinion mechanism or other means to synchronize their counter-vibrating pistons.

DISCLOSURE OF THE INVENTION

An object of the present invention is the efficient accommodation by simple machine of the thermodynamic processes of a heat engine.

Another object of this invention is a free-piston engine which operates continuously and stably in the face o changes in energy input and gas pressures.

Another object of this invention is a free-piston engine in which the pressure and volume of the output gas are independently adjustable.

Another object of this invention is a free-piston engine whose piston has a long and variable stroke.

Another object of this invention is a free-piston engine whose stroke si long enough to bring in sufficient excess air to cool the combustion chamber.

Another object of this invention is a free-piston engine whose displacement volume is commensurate with the power level.

Another object of this invention is a free-piston engine whose pressure and volume of output gas are independently controllable.

Another object of this invention is an efficient free-piston engine with a totally unconnected single diameter piston.

Another object of this invention is a free-piston engine suitable for conventional crank engine type of lubrication and cooling use the piston's side away from the combustion chamber.

Further objects and advantages of this invention will become apparent from a consideration of the drawings and ensuing description.

BEST MODE FOR CARRYING OUT THE INVENTION

Figures 1, 2:
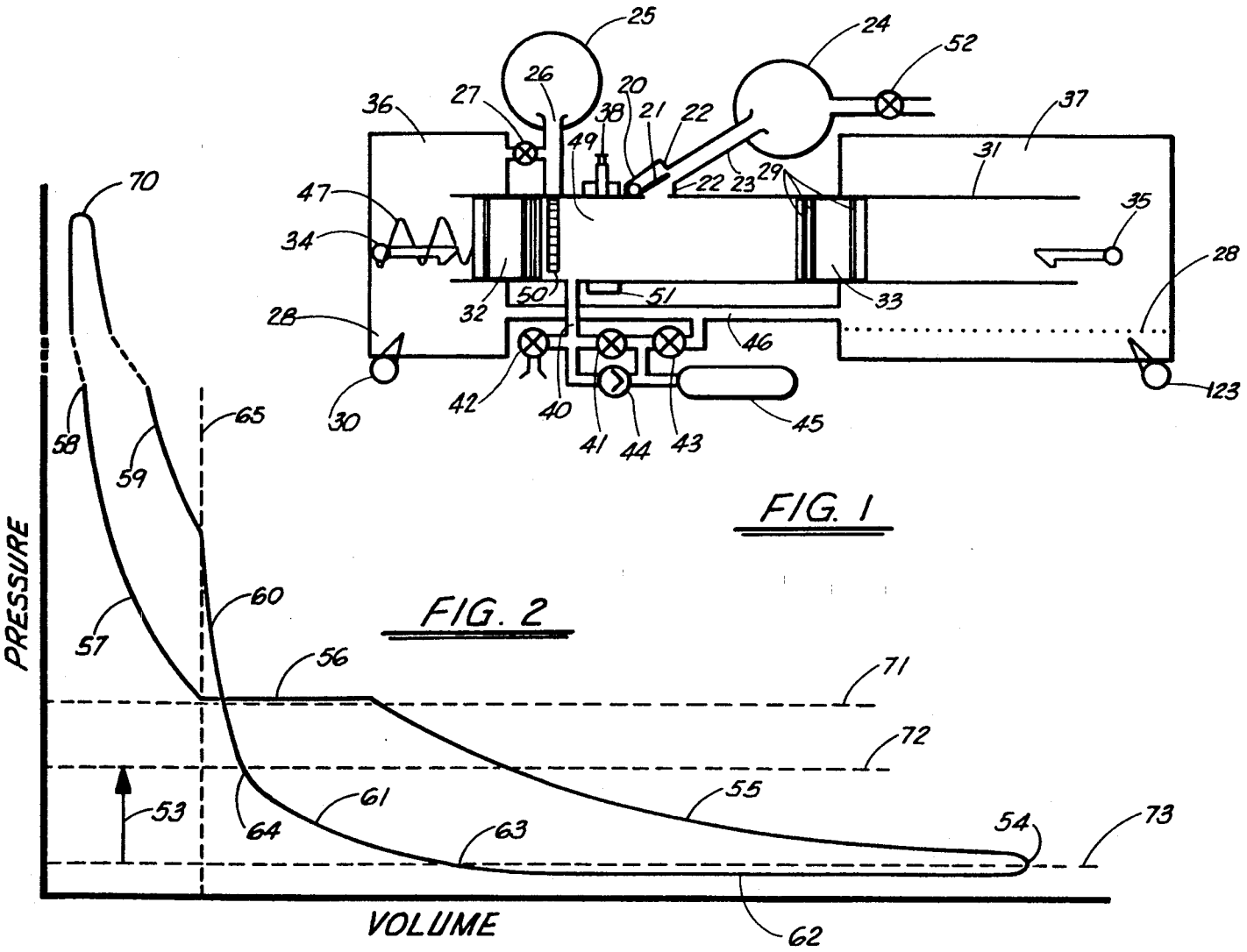
FIG. 1 is a schematic cross-sectional illustration of an engine of the present invention.
FIG. 2 is a pressure-volume curve of an engine of the present invention.

Referring to FIG. 1, cylindrical casing 31 contains the heavy piston 32 and the light piston 33, both having piston rings 29. The stroke of the counter-balancing, oppositely moving pistons are inversely proportionate to their masses. Spring 47 maintains the reciprocating pistons in the same average lengthwise position in the casing 31. Intake port with non-return reed valve 50 draws air through intake tube 26, whose inertial effect enhances the amount of air drawn from intake manifold 25. Conduit 40 for pressurizing valve 41, bleed valve 42, and check valve 44 passes through the casing 31. When running the check valve 44 recharges the air supply 45. Gas jets 30 and 123 prowl an aerosol of foil 28 into the casing ends to cool and lubricant the pistons 32 and 33.

For starting bleed valve 27 and the output valve 52 are closed. Air from the air supply 45 through valve 41 enters the combustion pressure chamber 49 side of the pistons 32 and 33 driving the pistons apart till they engage detents 34 and 35 each by an internal annular edge, not shown. Valve 42 then releases ar from between the pistons. Valve 43 then pressurizes rebonding volumes 36 and 37 through channels 46. With valve 42 closed, detents 34 and 35 then simultaneously release the pistons 32 and 33 which accelerate rineward. The combustions chamber's strain sensor 51, through control circuitry not whose, causes fuel to be injected from injector 38 as the pistons approach the inward turnaround. Piston position is also sensed by electrical induction, not shown. when running the output valve 52 is open.

Referring to FIG. 2, the arrow 53 represents the starting pressurization of the rebounding volumes 36 and 37. The initial inward movement of the pistons 32 and 33, which compresses air 55 between the pistons 32 and 33, continues until the pressure in the combustion chamber 49 approaches the pressure 71 in the output manifold 24. The spring hinged flapper valve 21 then permits the gas pumping 56 into the output manifold 24. When the piston 33 covers 65 the flapper valve 21 port, the flow ceases and the combustion chamber's pressure rises 57 to the compression pressure 58 sensed by the strain sensor 51 where injection of fuel through the injector 38 occurs followed by compression-ignition, combustion, and a further increase in the pressure to the high pressure 70. The initial expansion 59 accelerates the piston outward uncovering the flapper valve's 21 port. The pressure in the combustion chamber 49 acts on the flapper 21, which is closely fit by the shroud 22, The flapper 21 is accelerated and abruptly initiates flow through channel 23 with little throttling loss, bringing down the pressure 60 in the combustion chamber 49. By increasing the mass of the flapper 21 the point in time at which the flapper 21 opens the channel 23 can be delayed permitting further expansion by the piston before the channel 23 is opened. The momentum of the flow in channel 23 continues by inertia and pumps gas from the combustion chamber 49 to a pressure 64 lower than the output pressure 71. The flapper valve 21 urged by its spring hinge, and pressure in the outer portion of the shroud 22, and return flow of channel 23 into the combustion chamber 49, if present, closes to retain the lowered pressure 64 in the combustion chamber. The combination to the forces acting on the flapper 21 with its mass determine the length of time the flapper valve 21 is open. In this way, the timing of valving by the flapper 21, both its start and duration, are controlled by characteristics of the flapper valve 21. The duration is turned to the time it takes for the volume to the chamber 49 to discharge through the channel 23 and run below the pressure in the output manifold 24. The gas in the combustion chamber is then further expanded 61 by the continued outward movement to the pistons 32 and 33 to the intake manifold's 25 pressure 73. Intaking occurs when the combustion chamber's pressure 62 falls blow the intake pressure 73. The distance that the pistons run wound, the stroke 54, and thereby the volume intaken is determined by the kinetic energy the pistons derive from the expansion of the compressed gas in the combustion chamber as countered by the pressure 72 in the rebounding volumes 36 and 37. When he pistons 32 and 33 have been stopped by the rebounding volumes' 36 and 37 pressure they turn and start inward again 55 driven by rebounding volumes' 36 and 37 pressure; and the cycle repeats.

The pressure and volume of gas pumed is determined by the quantity of fuel injected. combustion chamer's 3 49 strain sensor 51 measures the high pressure 70 and lowers the rebounding volumes' 36 and 37 running pressure 72, which builds up due to blow by and jets 30 and 123 and gas derived from, not shown, the output manifold 24. Releasing pressure 72 through need valve 27 increasing the stroke 54 and the intaken and pumped volume. This added pumped volume requires more or the available work, leaving less work available for the compression 57 thereby lowering the high pressure 70. In the absence of excessive high pressure 70 bleed valve 27 is closed.

While the above description contains many specificities, these should not be construed as limitations on the scope of the present invention but as exemplifications of details of construction and arrangement of parts. Many other variations are possible.

I claim:

1. Apparatus utilizing energy to pump gas comprising: a piston fitted to a using, said piston freely moving in said casing in response to gas pressure differences on said piston; a pressure chamber to one side of said piston comprising means to increase the pressure or volume of gas in said pressure chamber to cause outward acceleration of said piston; a rebounding vole to the other side of said piston opposing the outward movement of said piston by the gas pressure in said rebounding volume; said rebounding volume maintaining a substantially constant pressure opposing said outward movement of said piston; said piston executing a stroke between said pressure chamber and said rebounding volume; an intake means through which gas enters said pressure chamber; and an outlet port in said casing located so as to be uncovered by said piston substantially before said piston has reached the outward end of said stroke of said piston.

2. Apparatus as claimed in claim 1 where the outlet port connects to a channel proportioned to utilize energy from gas passed through said channel to pump additional gas from said pressure chamber.

3. Apparatus as claimed in claim 1 where the outlet port has a valve to control the timing of the flow of gas in said outlet port.

4. Apparatus as claimed in claim 2 where the outlet port has a valve to control the timing of the flow of gas in from said outlet.

5. Apparatus as claimed in claim 1 comprising means to prevent flow into said pressure chamber from said outlet port.

6. Apparatus as claimed in claim 1 wherein the pressure of said pressure chamber and the pressure of said rebounding volume act on opposite faces of said piston.

7. Apparatus as in claim 1 further including lubricating means operating from the same side of said piston as said rebounding volume.

8. Apparatus as in claim 1 further including a gas cooling means operating on said piston on the opposite side of said piston from said pressure chamber.

9. Apparatus as claimed in claim 1 further including a second piston in counter motion to said piston.

10. Apparatus as claimed in claim 9 wherein said second piston has a substantially different mass than said piston.

11. Apparatus as claimed in claim 10 wherein one of the said pistons is connected by a spring to the casing.

12. A free-piston internal combustion engine comprising: a piston fitted to a casing; a combustion chamber to contain gas under high pressure to one side of said piston; means releasing combustion products from said combustion chamber after a partial expansion from said high pressure by said piston's movement in said casing; a further expansion by a continuation of said movement of said piston after said release the drawing in of gas by said continuation of movement; said piston executing a stroke in said casing away from said combustion chamber before being returned by a rebounding means; and the length of said stroke of said piston being in proportion to said high pressure in said combustion chamber

13. Apparatus as claimed in claim 12 where the outlet port has a valve to control the timing of the flow of gas in said outlet port.

14. A free-piston internal combustion engine as described in claim 12 further including means to prevent flow back into the combustion chamber from said releasing means.

15. A free-piston internal combustion engine as described in claim 12 having means to utilize the energy of the gas released by said releasing means to pump gas from the combustion chamber.

16. Apparatus as claimed in claim 12 where the outlet port has a valve to control the timing of the flow of gas in said outlet.

17. A free-piston internal combustion engine as described in claim 12 wherein said length of stroke is capable of substantial variation.

18. A free-piston internal combustion engine as described in claim 12 including lubricating means operating on said casing on the opposite side of said piston from said combustion chamber.

19. A free-piston internal combustion engine as described in claim 12 including gas cooling means operating on the opposite side of said piston rom said combustion chamber.

20. A free-piston internal combustion engine comprising: a piston fitted to a casing; a combustion chamber to one side of said piston; means releasing combustion products after a partial expansion of said combustion chamber by said piston; a further expansion of by said piston after said release; rebounding means operating on said piston to oppose the movement caused by the pressure of said combustion chamber; said rebounding means taking energy from the outward travel of said piston and giving back to said piston on its return inward travel energy substantially equal in amount to said taken energy.

21. A free-piston internal combustion engine as described in claim 20 wherein said piston on said piston's return inward travel pumps substantial gas to the output

22. A free-piston internal combustion engine as described in claim 20 having means to utilize the energy of the gas released by said releasing means to pump gas from said combustion chamber.

23. Apparatus as claimed in claim 20 where said releasing means controls the timing of release of said combustion products.

24. Apparatus as claimed in claim 23 where said releasing means controls the timing of release of said combustion products.

25. A free-piston internal combustion engine as described in claim 20 further including means to prevent flow back into the combustion chamber form said releasing means.

26. A free-piston internal combustion engine as described in claim 20 including lubricating means operating on the opposite side of said piston from said combustion chamber.

27. A free-piston internal combustion engine as described in claim 20 utilizing a gas pressure rebounding means; and gas cooling of said piston.

* * * * *